US005964225A

United States Patent [19]

Blackwell et al.

[11] Patent Number: 5,964,225

[45] Date of Patent: Oct. 12, 1999

[54] TOBACCO TREATMENT CYLINDER AND METHOD

[75] Inventors: Robert S. Blackwell, Mechanicsville; Roger L. Honaker, Midlothian, both of Va.

[73] Assignee: Philip Morris Incorporated, New York, N.Y.

[21] Appl. No.: 08/921,265

[22] Filed: Aug. 29, 1997

[51] Int. Cl.[6] ..... A24B 3/04

[52] U.S. Cl. ..... 131/305; 131/300; 34/108; 366/54; 366/57

[58] Field of Search ..... 131/300, 305, 131/302, 304; 34/108, 132; 366/22, 54, 56, 57

[56] References Cited

U.S. PATENT DOCUMENTS

| | | | |
|---|---|---|---|
| 3,556,498 | 1/1971 | Sheahan | 263/34 |
| 5,425,384 | 6/1995 | White | 131/305 |

*Primary Examiner*—James Derrington
*Assistant Examiner*—Steven B. Leavitt
*Attorney, Agent, or Firm*—Charles E.B. Glenn; Kevin B. Osborne

[57] ABSTRACT

A tobacco treatment system comprising a rotatable cylinder and a plurality of axially directed flights, with each flight having a forward side and a back side relative to the rotational motion of the cylinder, with both the forward and back sides being concave-open in a direction toward the interior of the cylinder.

7 Claims, 4 Drawing Sheets

TOBACCO TREATMENT CYLINDER AND METHOD

FIELD OF INVENTION

The present invention relates generally to apparatus and processes for treating tobacco, and more particularly, to rotatable cylinders having internal arrangements for promoting uniform treatment of tobacco.

BACKGROUND OF THE INVENTION

Preparation of tobacco for use in the production of cigarettes typically includes the application of casings, flavors, moisture and the like. One established practice has included the step of directing rag or cut tobacco through a rotatable cylinder that is established at a slight incline so that as tobacco is introduced at an inlet end, it is tossed about the cylinder as it progresses down the, length of the cylinder under the influence of gravity and the rotational motion of the cylinder. The desired fluid materials are sprayed upon the tobacco from nozzles that are located at space locations along the cylinder.

Several prior designs have included placement of paddles along the interior of the cylinders so as to impart rotational motion to the tobacco feedstock. In another arrangement, flanges extend longitudinally along the interior walls of the cylinder for the same purpose. Another arrangement included flights having triangular and/or truncated triangular cross-sections.

A problem with the aforementioned prior designs is that tobacco would tend to collect in corners between the flanges and the proximate portions of the cylinder walls. Once the accumulated tobacco is wetted by the fluid applicators within the cylinders, the accumulated tobacco would tend to stick and remain in the cylinder from one operation to the next and spoil, increasing the risk of producing unacceptable product.

OBJECTS AND SUMMARY OF THE INVENTION

An object of the present invention is to provide a tobacco treatment cylinder arranged so as to avoid unwanted trapping of tobacco within the cylinder.

Another object of the present invention is to provide a treatment cylinder for tobacco wherein continuous rollover motion is imparted to the tobacco during operation of the cylinder, substantially free of any portion of the tobacco mass becoming stagnant and subject to an excess of treatment.

Yet another object of the present invention is to improve even treatment of tobacco while also reducing risk of spoiled tobacco.

These and other objects of the present invention are achieved with a tobacco treatment system comprising a cylinder and a plurality of axially directed flights, with each flight having a forward side and a backside relative to the rotational motion of the cylinder, with both the forward and back sides being concave-open in a direction toward the interior of the cylinder. The forward and backsides of each flight meet at an apex of sufficient height to carry the tobacco on an angular path-portion sufficient such that upon release and sliding of the tobacco held by a particular flight, it falls upon a prior trailing flight so as to wipe the surfaces of the latter and remove collected material, if any.

BRIEF DESCRIPTION OF THE DRAWING

Other objects, advantages and novel features of the present invention will become apparent from the following detailed description of the preferred embodiment when considered in conjunction with the accompanying drawings, wherein.

DETAILED DESCRIPTION OF THE PREFERRED EMBODIMENT, INCLUDING A DESCRIPTION OF PRIOR ART

Figure 1:
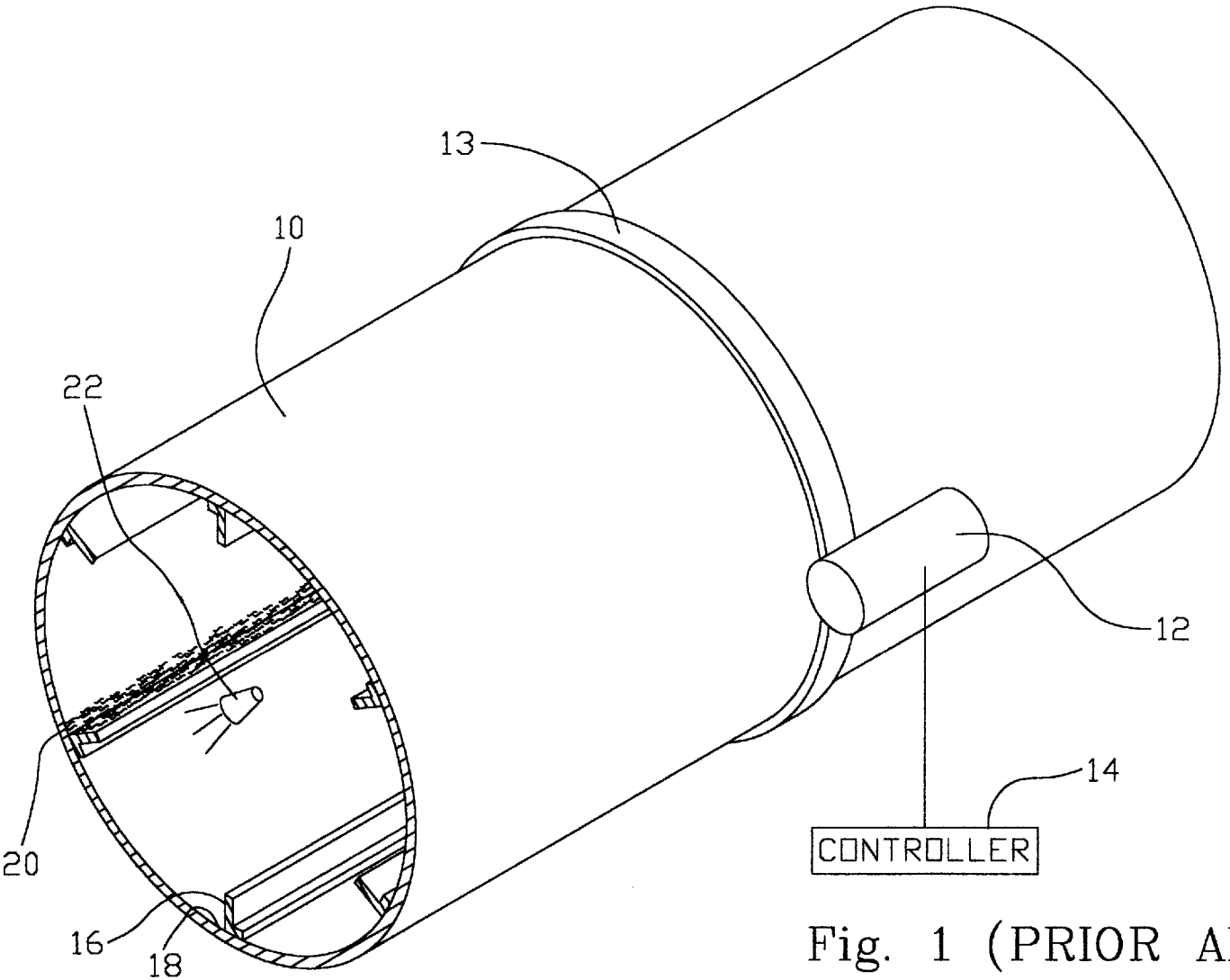
Fig. 1 (PRIOR ART)
FIG. 1 (prior art) is a sectional perspective view of a tobacco treatment cylinder constructed in accordance with the prior art.

Referring to FIG. 1 (prior art), prior systems have included a rotatable cylinder 10 driven by a motor 12 whose output drive engages a geared track 13 along the outer periphery of the cylinder 10. The drive motor 12 is controlled by a controller 14 so as to start, stop and control the speed of the cylinder 10.

Extending axially along the interior of the cylinder are a plurality of circumferentially spaced-apart, radially inwardly extending flanges 16 for imparting rotational motion of the cylinder to tobacco feedstock placed with the cylinder 10. One or more fluid applicators or nozzles 22 are fixedly located within the cylinder 10 and are arranged to spray fluid upon the tobacco being treated within the cylinder 10.

At locations about the cylinder, where each flange 16 affixes to the interior wall of the cylinder 10, a corner 18 is defined therebetween which is tantamount to collection sites for tobacco such as a tobacco accumulation 20. Once these tobacco accumulations 20 become wetted by the output of the fluid applicators or nozzles 22, they become tacky and affix themselves to the corner regions 18 about the cylinder 10. If they are not removed, the tobacco accumulations 20, being wetted, may tend to spoil and ruin product. Additionally, the need to repetitively undertake cleaning operations to effect their removal creates downtime in the operation of the cylinder 10 and operational inefficiencies.

Figure 2:
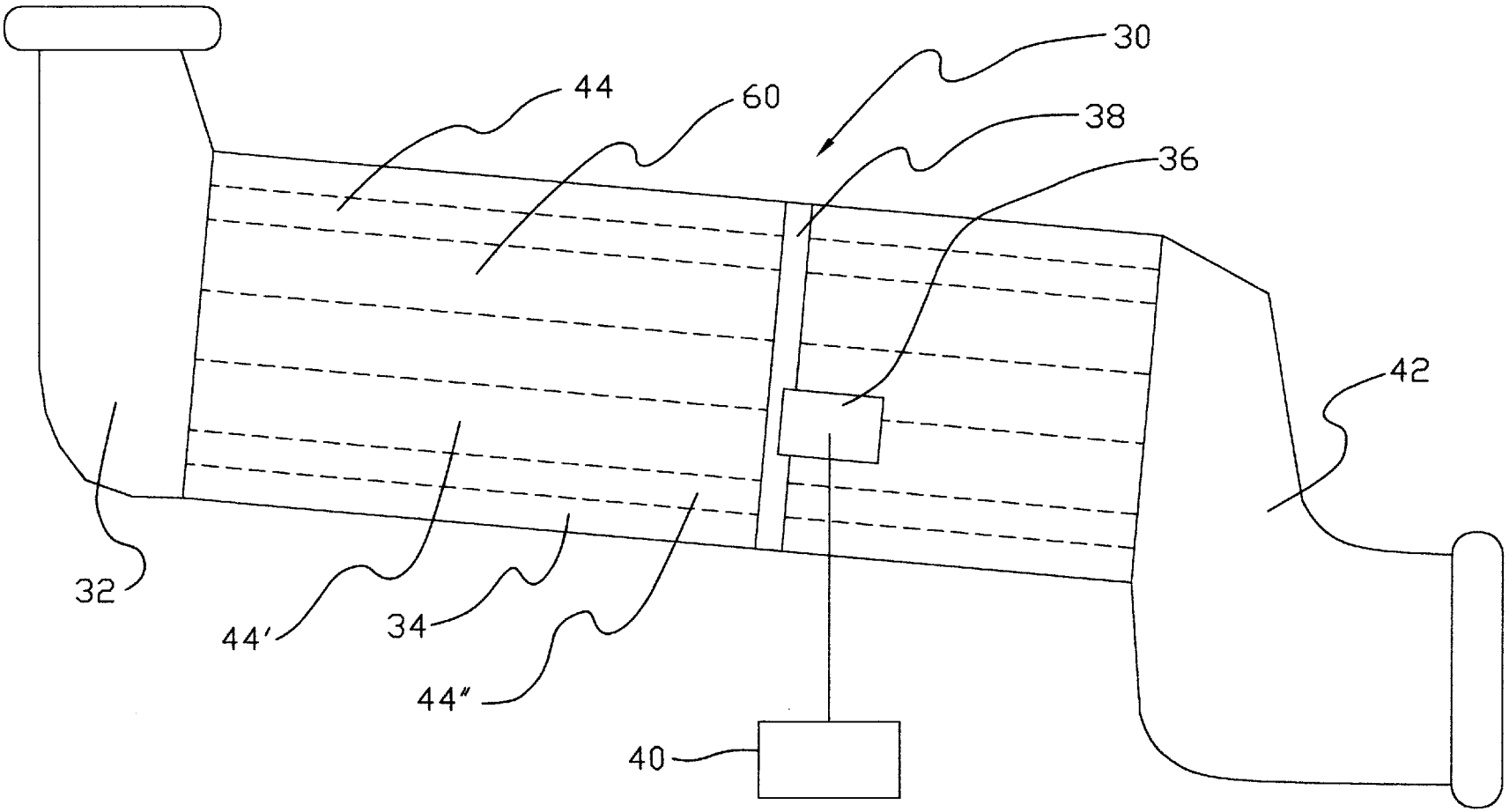
FIG. 2 is a side view of a tobacco treatment cylinder system constructed in accordance with a preferred embodiment of the present invention.
Figure 3:
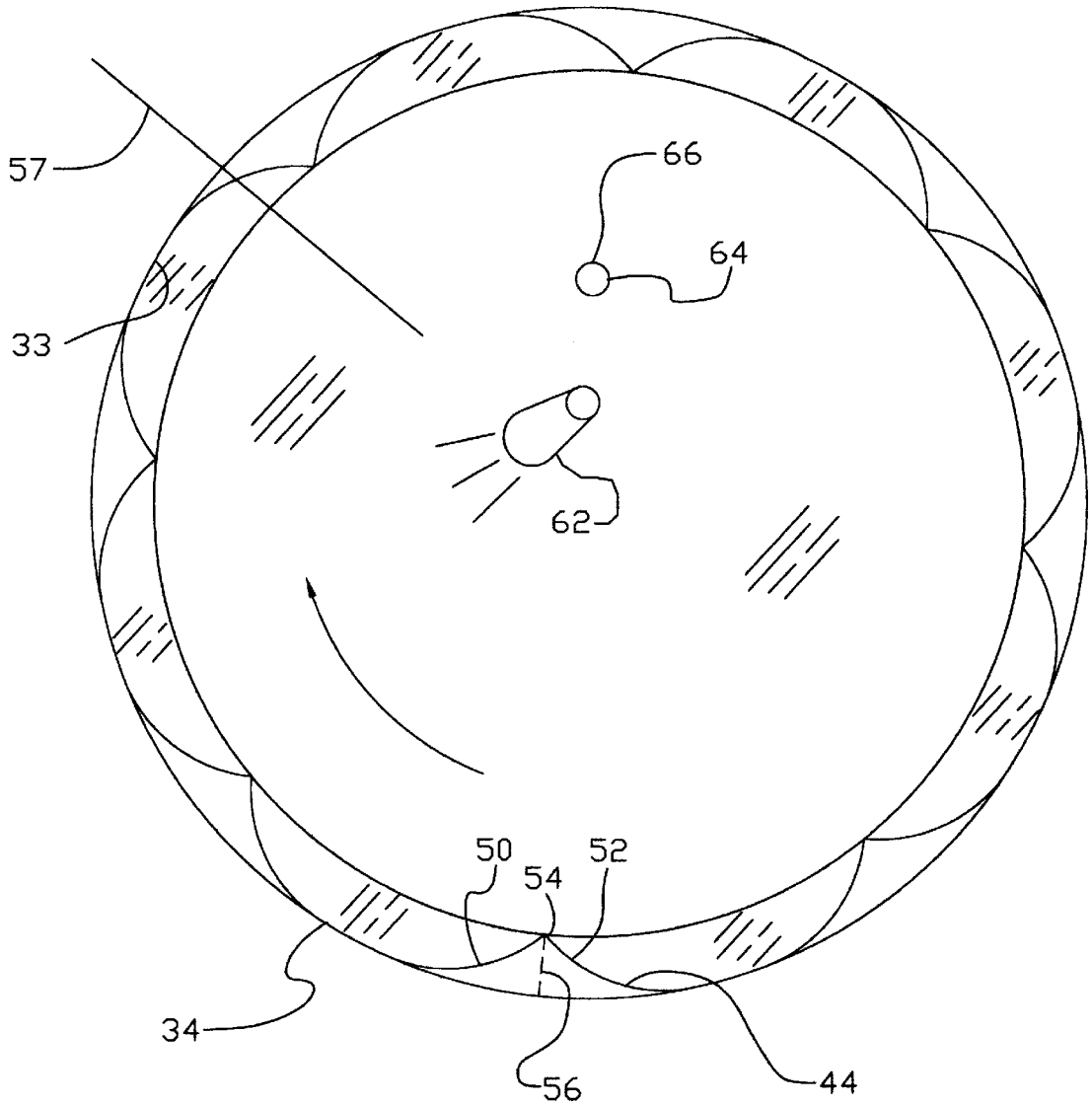
FIG. 3 is a cross-sectional representation of a tobacco treatment cylinder constructed in accordance with a preferred embodiment of the present invention.

Referring now to FIGS. 2 and 3, a preferred embodiment of the present invention provides a tobacco treatment cylinder system 30 having an inlet portion for receiving tobacco and directing it to the interior of a rotatable cylinder 34. The rotatable cylinder 34 is rotatably driven by a motor 36 in cooperation with a geared track 38, all of which is under the control of a controller 40. One of ordinary skill in the art would realize that there exist a number of alternate drive and control arrangements which could be employed instead of the arrangement described herein. Tobacco entering the cylinder 34 from the inlet 32 is moved toward the outlet portion 42 of system 30 upon the influence of gravity and the rotational motion of the cylinder 34.

A plurality of radially inwardly extending, circumferentially spaced-apart flights 44 are provided axially along the interior walls 33 of the cylinder 34.

Referring particularly to FIG. 3, each flight in cross-section has a front side portion 50 and a backside portion 52 as oriented in the sense of rotational direction of the cylinder 34 such that the front side portion 50 leads the backside portion 52 as the cylinder 34 rotates. In the preferred embodiment rotation is clockwise as viewed in FIG. 3 so that the front side portion 50 is leading and to the left of the backside portion 52. Both the frontside portion and back portions 50 and 52 are concave-up in a radially inward direction toward the interior of the cylinder 34 and meet to form an apex 54 which is established at a predetermined radial height 56 from the interior wall 33 of the cylinder 34. The height 56 is established such that the flights 44 are capable of carrying tobacco to a predetermined angular position about the cylinder 34 before tobacco releases and slides off the flight 44 under the influence of gravity. In the preferred embodiment, with its clockwise direction of rotation, the release position is preferably established at approximately the ten o'clock position about the cylinder 34 as indicated at designation 57 in FIG. 3.

Preferably, intermediate portions 60 of the cylinder wall are interposed between each of the flights 44. A fluid applicator is preferably spaced above the center line of the cylinder and discharges generally toward an eight o'clock position of the cylinder 34. An axially extended steam pipe 64 having a plurality of axially spaced steam discharge ports 66 are provided for introducing steam and heat into the cylinder as desired. The cylinder 34 is readily useable with various other types of fluid applicators.

Figure 4:
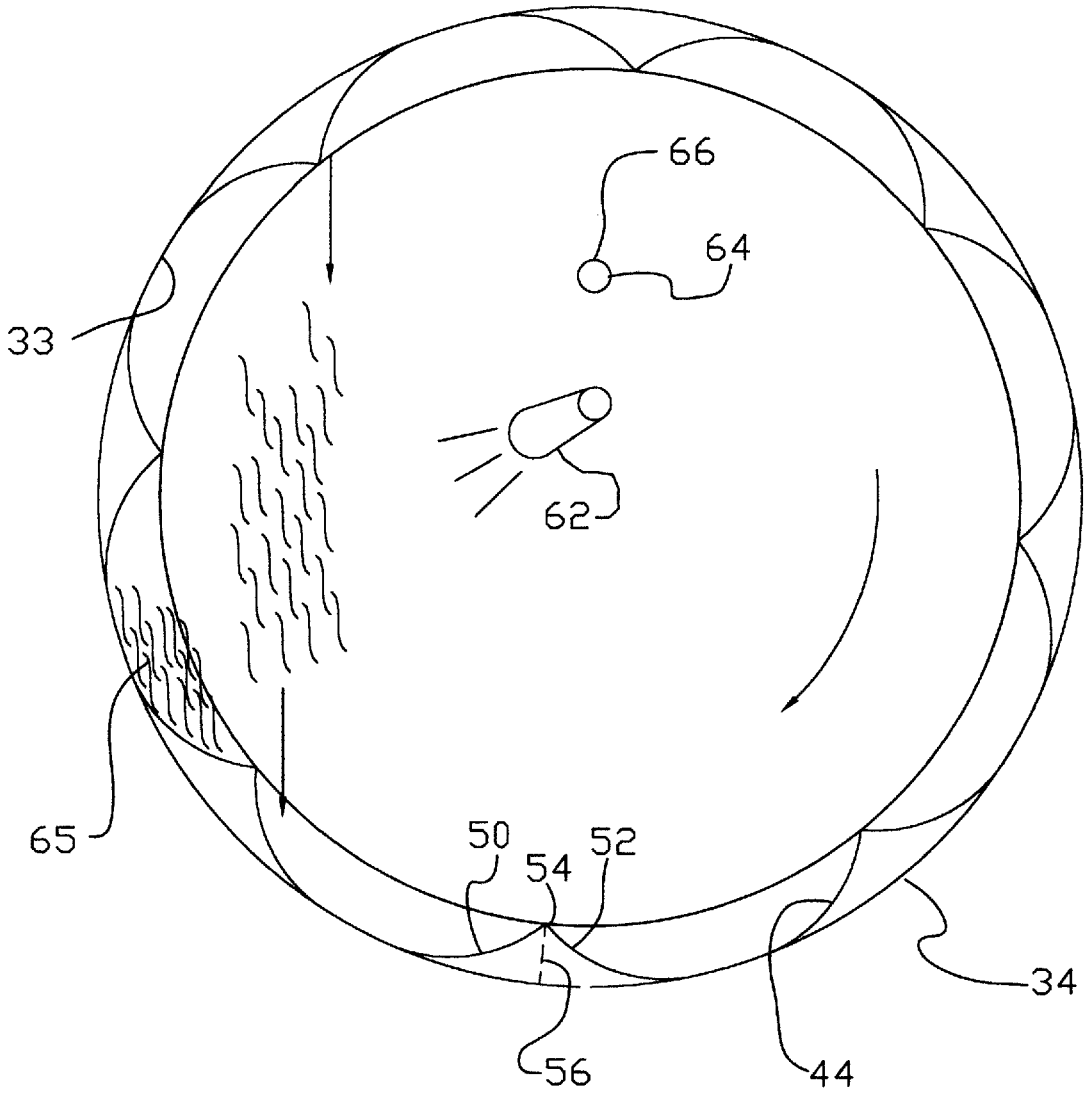
FIG. 4 is a cross-sectional representation of a tobacco treatment cylinder in the process of treating tobacco feed stock.

Referring now to FIG. 4, during operation of the cylinder, portions 65 of tobacco are retained by frictional contact and inertia upon the arcuate forward portion 50 of each flight 44 as each flight 44 is rotated in turn through the six o'clock position of the cylinder 34 and beyond. Starting at approximately the nine o'clock position, each tobacco portion 65 releases from the surface of the respective flight 44 to slide therealong and fall within the interior of the cylinder, preferably with tumbling of the tobacco. Preferably the cylinder rotational speed and the height 56 of the flights 44 are selected such that at least a portion if not most of the tumbling tobacco falls upon the backside 52 of a trailing flight 44'. Preferably, for a given flight height 56, cylinder speed is adjusted such that as each tobacco portion 65 tumbles from a first ("leading") flight, it mostly falls upon the backside 52 of the next, but one, preceding flight 44 (that is, it preferably falls substantially on the backside 52 of a preceding flight 44 that is one flight spaced away from the leading flight from which the tobacco portion 65 is falling). Because the tobacco slides along the forward portion 50 of a leading flight 44, it sweeps the forward surface of extraneous tobacco. Likewise, the tumbling tobacco 65 sweeps and keeps clean the backside portion 52 of the next but one preceding (trailing) flight 44.

If desired, cylinder speed and/or the height 56 of the flights 44 and/or the number of flights may be varied to have each tumbling tobacco portion 65 fall, in the alternative, upon the backside portion 52 of the immediately preceding flight 44 or some other preselected flight 44 such as the next but two preceding flight.

Figure 5:
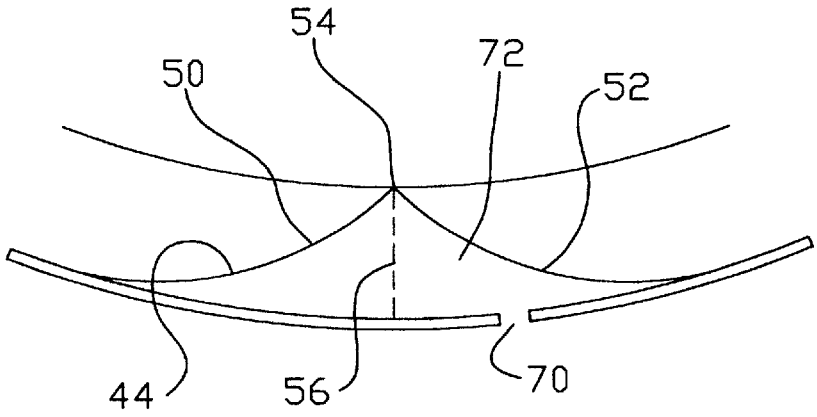
FIG. 5 is a cross-sectional detail view of a flight constructed in accordance with the preferred embodiment of FIGS. 2 and 3.

Referring to FIG. 5, a preferred cross-sectional shape of the flight can be determined from employing a height 56 found to be effective for cylinders of similar size, throughput and speed, but which incorporate flanges of prior designs. Using this approach, the height 56 is approximated to the height of those prior flange designs. Preferably, the concave forward and backside portions 50,52 are provided a shape which from observation corresponds with the shape that tobacco generally would collect against the flange of the aforementioned prior designs. Preferably, such is approximated by providing each of the front and backside portions 50, 52 a preselected radius of curvature.

For example, for a cylinder 34 of a six (6) foot diameter, a twenty-four (24) foot length and rotational speed in the range of approximately 12 to 16 revolutions per minute (rpm), the front and backside portions 50, 52 are preferably provided a preselected radius of curvature in the range of approximately 10 to 17 inches, more preferably, in the range of approximately 11 to 13 inches. With such a cylinder, the height 56 of each flight 44 is established in the range of approximately 2.5 to 5 inches, more preferably, in the range of approximately 3.5 to 4.5 inches. Preferably, with a total of eight flights 44, intermediate portions 60, each of approximately 2.75 inch breadth, are interposed between each of the flights 44.

It is also preferred to provide a vent 70 or some other equivalent arrangement to allow air to escape from the interior space 72 encompassed by the flights 44.

Many modifications, substitutions and improvements may be apparent to the skilled artisan without departing from the spirit and scope of the present invention as described and defined herein and in the following claims.

What is claimed is:

1. A tobacco treatment apparatus comprising:

a rotatable cylinder having an interior wall; and a flight disposed axially along at least a portion of said interior wall, said flight having a forward portion and a backside portion relative to the rotational motion of said cylinder, both said forward portion and said backside portion being concave toward an inner portion of said cylinder such that said cylinder is essentially free of corner regions between said flight and said interior wall wherein both said forward portion and said backside portion are concave and meet at an apex of sufficient height to carry tobacco along an angular path-portion as said cylinder rotates.

2. The tobacco treatment apparatus as claimed in claim 1 further comprising a fluid applicator operative within an interior portion of said cylinder.

3. The tobacco treatment apparatus as claimed in claim 1, wherein said flight includes a first, second and third flight, said second flight preceding said first flight and said third flight preceding said second flight, said first, second and third flights mutually arranged so that upon rotation of said cylinder, said backside portion of said third flight is wiped by tobacco tumbled from said first flight.

4. The tobacco treatment apparatus as claimed in claim 3, wherein said forward portion and said backside portion have a radius of curvature in the range of approximately 10 to 17 inches.

5. The tobacco treatment apparatus as claimed in claim 4, wherein said forward portion and said backside portion have a radius of curvature in the range of approximately 11 to 13 inches.

6. The tobacco treatment apparatus as claimed in claim 5 further comprising a fluid applicator operative within an interior portion of said cylinder.

7. A method of treating tobacco comprising the steps of:

tumbling tobacco within a rotating cylinder amongst first, second and third flights in succession, each flight having a concave forward portion and a concave backside portion relative to the rotational motion of the cylinder, said concave forward and backside portions being concave toward an inner portion of said cylinder wherein both said forward portion and said backside portion are concave and meet at an apex of sufficient height to carry tobacco along an angular path-portion as said cylinder rotates;

said tumbling step including the step of wiping said concave backside portion of said third flight with tobacco tumbled from said first flight.

* * * * *